US012532991B2

(12) United States Patent
Ge

(10) Patent No.: US 12,532,991 B2
(45) Date of Patent: Jan. 27, 2026

(54) FOOT TUB CAPABLE OF GENERATING BUBBLE IN USE

(71) Applicant: HUAIAN MIMIR ELECTRIC APPLIANCE CO., LTD., Huaian (CN)

(72) Inventor: Jun Ge, Huaian (CN)

(73) Assignee: HUAIAN MIMIR ELECTRIC APPLIANCE CO., LTD., Huaian (CN)

( * ) Notice: Subject to any disclaimer, the term of this patent is extended or adjusted under 35 U.S.C. 154(b) by 156 days.

(21) Appl. No.: 18/581,396

(22) Filed: Feb. 20, 2024

(65) Prior Publication Data

US 2024/0423419 A1 Dec. 26, 2024

(30) Foreign Application Priority Data

Jun. 21, 2023 (CN) ..... 202321591642.4
Jun. 25, 2023 (CN) ..... 202321604143.4
Dec. 22, 2023 (CN) ..... 202323518105.X

(51) Int. Cl.
*A47K 3/10* (2006.01)
*A47K 3/022* (2006.01)

(52) U.S. Cl.
CPC ..... *A47K 3/10* (2013.01); *A47K 3/022* (2013.01)

(58) Field of Classification Search
CPC ..... A47K 3/10; A61H 2205/12–125; A61H 33/002; A61H 33/0087–0091; A61H 33/02; A61H 33/60; A61H 33/6047; A61H 35/00; A61H 35/006
See application file for complete search history.

(56) References Cited

U.S. PATENT DOCUMENTS 2,733,711 A * 2/1956 Gibson ..... A61H 33/027 4/590
4,982,461 A * 1/1991 Mikiya ..... A61H 33/6047 4/541.3
5,197,153 A * 3/1993 Hara ..... A61H 33/60 4/541.4
6,309,366 B1 * 10/2001 Maxwell ..... A61H 35/006 601/55

(Continued)

FOREIGN PATENT DOCUMENTS

CN 101336810 * 1/2009 ..... A61H 35/00
CN 217565847 U 10/2022
CN 217645078 U 10/2022

*Primary Examiner* — David P Angwin
*Assistant Examiner* — Nicholas A Ros
(74) *Attorney, Agent, or Firm* — Bayramoglu Law Offices

(57) ABSTRACT

A foot tub capable of generating a bubble in use includes a base and a tub wall connected to the base, where the base and the tub wall enclose a tub chamber; an impeller is provided in the tub chamber above the base; the impeller is covered by a protective guard; a hollowed-out opening is formed in the protective guard; the protective guard further communicates with an outside atmosphere through a vent tube; a drive motor is provided in the base, and the drive motor is drivingly connected to the impeller, such that the drive motor can drive the impeller to rotate; and in response to rotation of the impeller, while water is thrown out of the protective guard through the hollowed-out opening, a local low pressure is further formed in the protective guard, such that outside air can enter the protective guard through the vent tube.

13 Claims, 10 Drawing Sheets

(56) References Cited

U.S. PATENT DOCUMENTS

| | | | | |
|---|---|---|---|---|
| 6,363,548 | B1 * | 4/2002 | Kuo | A47K 3/022 4/541.4 |
| 7,600,273 | B2 * | 10/2009 | Gruenwald | A61H 33/02 4/541.1 |
| 8,708,672 | B2 * | 4/2014 | Marks | F04D 29/628 417/420 |
| 9,700,843 | B2 * | 7/2017 | Giraud | B01D 61/08 |
| 2005/0204467 | A1 * | 9/2005 | Bean | A47K 3/022 4/622 |
| 2015/0297446 | A1 | 10/2015 | Vinokur et al. | |

* cited by examiner

FOOT TUB CAPABLE OF GENERATING BUBBLE IN USE

CROSS REFERENCE TO THE RELATED APPLICATIONS

This application is based upon and claims priority to Chinese Patent Applications No. 202321591642.4, filed on Jun. 21, 2023; No. 202321604143.4, filed on Jun. 25, 2023; and No. 202323518105.X, filed on Dec. 22, 2023; and the entire contents of which are incorporated herein by reference.

TECHNICAL FIELD

The present disclosure relates to a foot tub.

BACKGROUND

Foot tubs are intended for leisure. For the sake of a more leisurely experience, there emerges a surfing foot tub, namely a bubbling foot tub. The existing surfing foot tub is generally provided with an air pump. This increases the cost and makes installation troublesome.

The Chinese utility patents CN 217645078 U and CN 217565847 U disclose a bubbling foot tub. A water pump is provided in a base of the foot tub. The water pump is connected to a connector in the base. The connector has an inner chamber. The connector is provided with a water inlet, a water outlet, and an air inlet. The water inlet, the water outlet, and the air inlet communicate with the inner chamber of the connector. The water inlet communicates with one end of a water intake tube. The other end of the water intake tube communicates with an inner chamber of a tub body, namely the water intake tube is also located in the base. The water outlet communicates with one end of a water discharge tube. The other end of the water discharge tube communicates with the inner chamber of the tub body, namely the water discharge tube is also located in the base. The air inlet communicates with one end of an air intake tube. The other end of the air intake tube is provided with a control switch. The control switch is configured to open or close the air intake tube. The foot tub has the following working principle: When the water pump works, water is pumped to the water discharge tube through the water intake tube, and the water gushes out from the water discharge tube to form a splash. Meanwhile, when the water pump works and the air intake tube is opened, a negative pressure generated by the working water pump in the connector sucks air to the water pump through the air intake tube. The air is mixed with the water and sprayed out, such that water sprayed out from the water discharge tube carries bubbles.

The patents CN 217645078 U and CN 217565847 U further have the following defects: 1. While pumping the water, the water pump further ensures that the pumped water can gush out from the water discharge tube. Hence, a high power of the water pump is required. Because of the negative pressure to be generated in the connector, the power of the water pump is desired to be higher. 2. Both the water intake tube and the water discharge tube are located in the base. When the water pumped from the water intake tube gushes out from the water discharge tube, there is a long route as well as a loss of many kinetic energies, and thus the splash from the water discharge tube is small. If a larger splash gushes out from the water discharge tube, the power of the water pump is further increased.

SUMMARY

In view of the defects of the existing foot tub, the present disclosure provides a foot tub capable of generating a bubble in use. The present disclosure generates a splash and a bubble more easily.

A technical solution employed by the present disclosure to solve the technical problem is as follows: A foot tub capable of generating a bubble in use includes a base and a tub wall connected to the base, where the base and the tub wall enclose a tub chamber;

an impeller is provided in the tub chamber above the base; the impeller is covered by a protective guard; a hollowed-out opening is formed in the protective guard; and the protective guard further communicates with an outside atmosphere through a vent tube;

a drive motor is provided in the base, and the drive motor is drivingly connected to the impeller, such that the drive motor can drive the impeller to rotate; and in response to rotation of the impeller, while water is thrown out of the protective guard through the hollowed-out opening, a local low pressure is further formed in the protective guard, such that outside air can enter the protective guard through the vent tube, and the water thrown out by the impeller in the rotation is mixed with the air to generate a bubble.

Further, the base is provided with a motor chamber protruding toward the tub chamber, and the drive motor is located in the motor chamber.

Further, an upper end of the tub wall is provided with a cover plate, and the vent tube is provided between the cover plate and the protective guard.

Further, a driving connection manner between the drive motor and the impeller is as follows: an output end of the drive motor is provided with a drive plate; a driving magnet is provided on the drive plate; a driven magnet is provided on the impeller; and the driving magnet is opposite to the driven magnet through unlike poles, such that the drive plate in rotation can drive the impeller through a magnetic attraction force to rotate.

Further, a rotating shaft is provided on the impeller; the rotating shaft is inserted into the base; and the impeller can rotate with the rotating shaft as an axis.

Further, another driving connection manner between the drive motor and the impeller is as follows: an output end of the drive motor is provided with a connecting shaft; the connecting shaft upwardly penetrates through the base and then is connected to the impeller; and at a penetration position, a space between the connecting shaft and the base is sealed.

Further, a cover plate air inlet is formed in the cover plate, and an upper opening of the vent tube is connected to the cover plate air inlet.

Further, a control switch for controlling an air intake amount is provided on the cover plate air inlet.

The tub wall is structured as follows: the tub wall is a flexible tub wall, such that the tub wall can be expanded or folded; the vent tube is rotatably connected to the cover plate, or the vent tube is rotatably connected to the protective guard; when the tub wall is expanded, the vent tube is supported between the cover plate and the protective guard, such that the vent tube serves as a support rod when the tub wall is expanded; and when the tub wall is folded, the vent tube is rotated and then accommodated between the cover plate and the base.

Further, an air inlet is formed in a sidewall of the vent tube; a lower end of the vent tube is provided with an air outlet; and the vent tube communicates with the protective guard through the air outlet when supported between the cover plate and the protective guard.

Further, a control mechanism for controlling the air inlet is provided on the air inlet.

Further, the control mechanism includes a control knob; the control knob is rotatably connected to the vent tube; a protruding tab is provided on a back of the control knob; a groove is formed in the tab; by rotating the control knob, the tab can seal the air inlet to close the air inlet, or the groove is aligned to the air inlet to open the air inlet.

Further, the groove is arc-shaped; the arc-shaped groove is gradually widen from a head to a tail; when a narrow portion of the groove corresponds to the air inlet, the air inlet has a small air intake amount; and when a wide portion of the groove corresponds to the air inlet, the air inlet has a large air intake amount.

Further, the lower end of the vent tube is provided with a spherical body; an upper end of the protective guard is provided with a spherical recess; an air vent is formed in the spherical recess; and when the vent tube is supported between the cover plate and the protective guard, the spherical body at the lower end of the vent tube is embedded into the spherical recess, such that the air outlet at the lower end of the vent tube is connected to the air vent.

Further, the vent tube includes a first rod and a second rod; and the first rod and the second rod are assembled to form the vent tube.

The present disclosure has the following beneficial effects: The impeller is directly located in the tub chamber. As long as the impeller rotates, the water can be thrown out easily to generate the splash, and a certain negative pressure can be generated in the protective guard to suck the air through the vent tube. The drive motor does not need a higher power to generate the splash and the bubble. The present disclosure generates the splash and the bubble more conveniently.

DETAILED DESCRIPTION OF THE EMBODIMENTS

Figure 1:
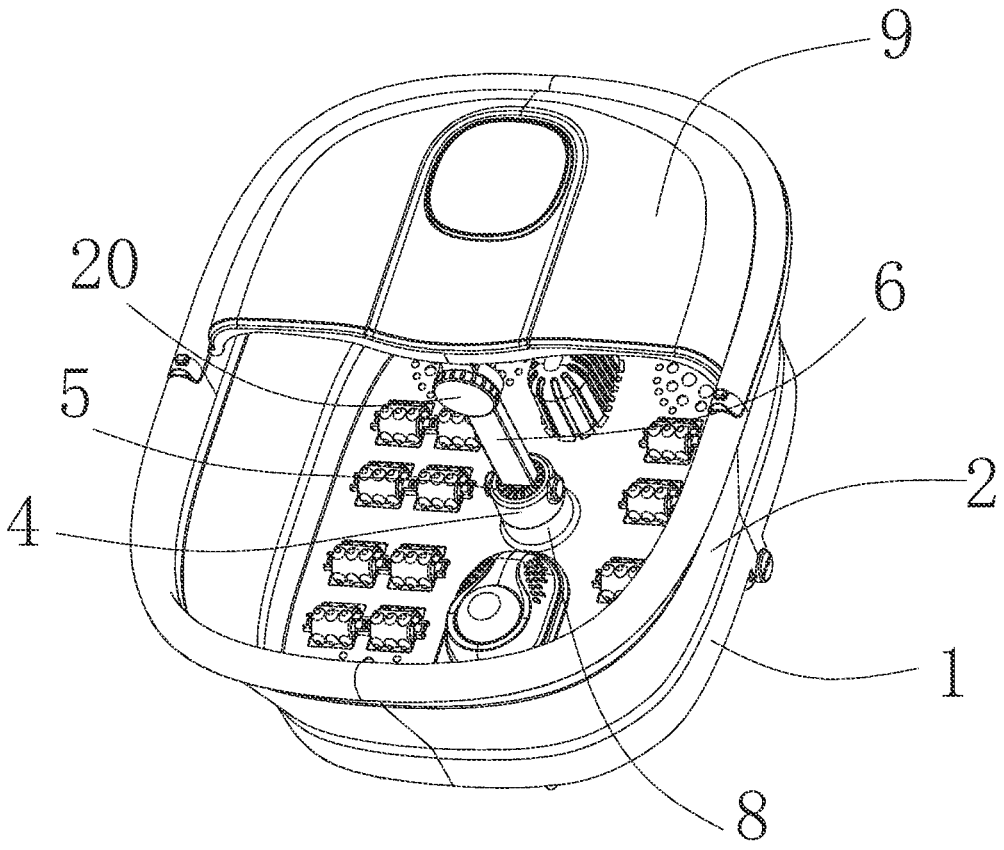
FIG. 1 is a schematic structural view of a foot tub with a collapsible tub wall.
Figure 2:
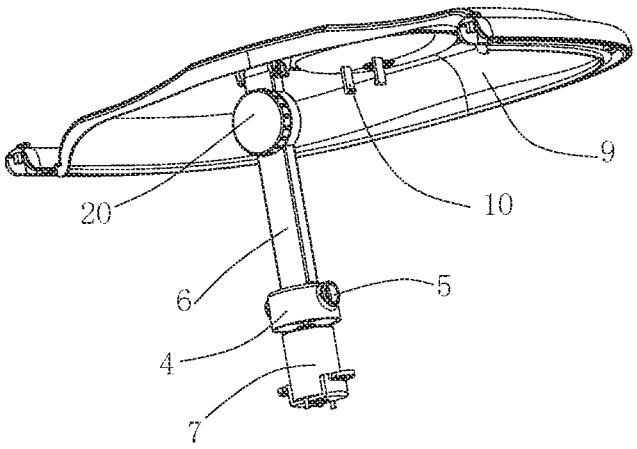
FIG. 2 is a schematic view illustrating an arrangement of a vent tube, a protective guard, and a drive motor of the foot tub in FIG. 1.
Figure 3:
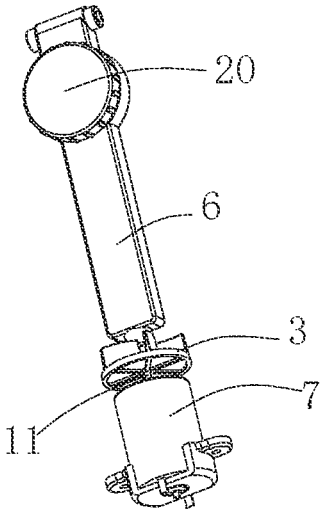
FIG. 3 is a schematic view illustrating an arrangement of a vent tube, an impeller, and a drive motor of the foot tub in FIG. 1.
Figure 4:
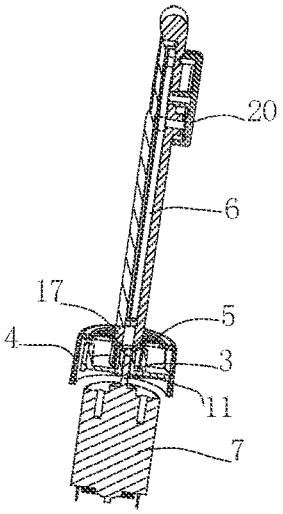
FIG. 4 is a sectional view of a vent tube, a protective guard, an impeller, and a drive motor of the foot tub in FIG. 1.
Figure 5:
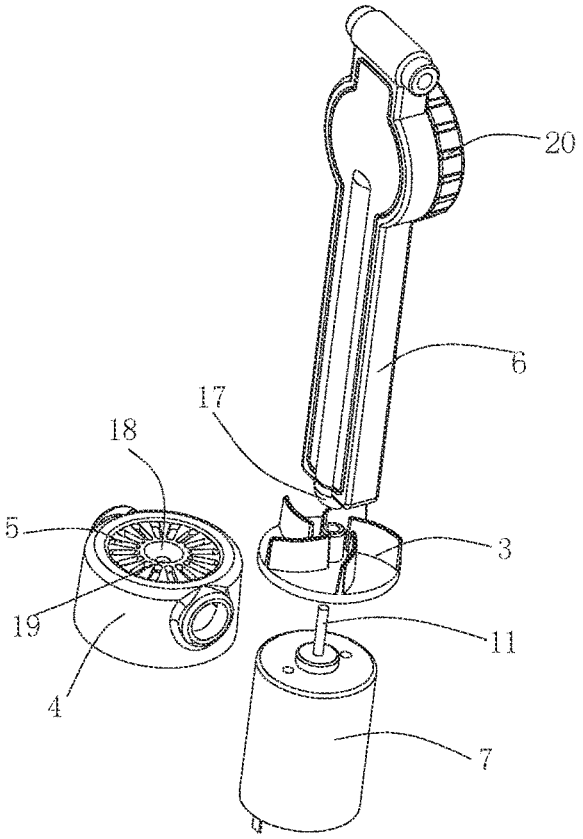
FIG. 5 is an exploded view of a vent tube, a protective guard, an impeller, and a drive motor of the foot tub in FIG. 1.
Figure 6:
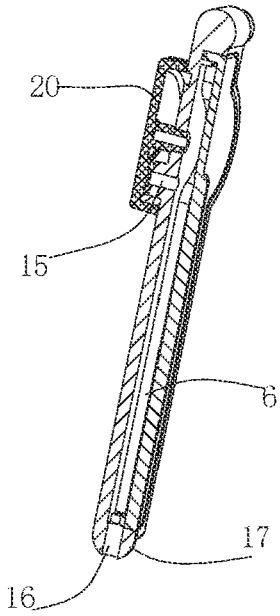
FIG. 6 is a sectional view of a vent tube of the foot tub in FIG. 1.
Figure 7:
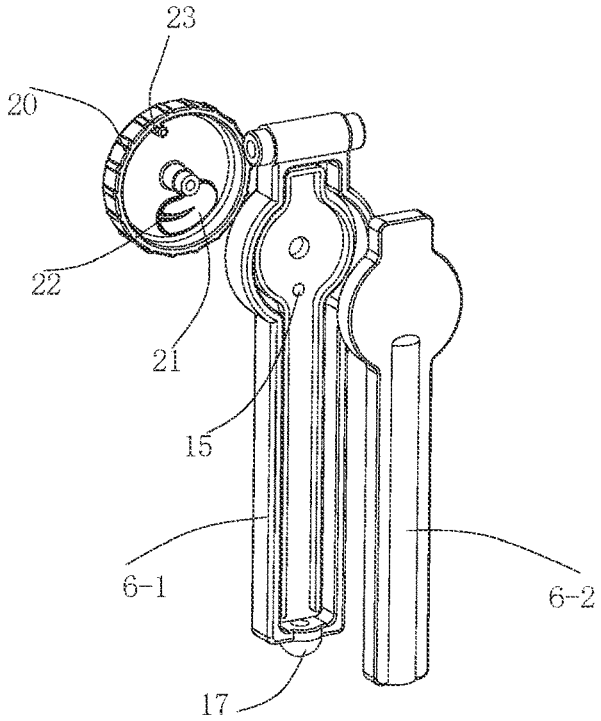
FIG. 7 is an exploded view of a vent tube of the foot tub in FIG. 1.
Figure 8:
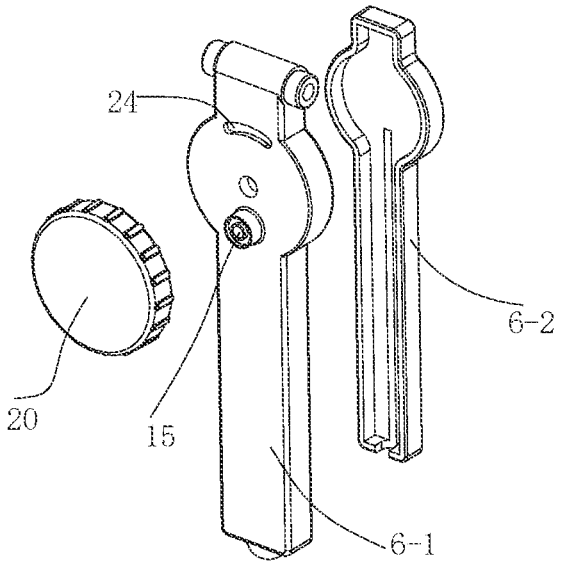
FIG. 8 is an exploded view of a vent tube of the foot tub in FIG. 1 from another perspective.
Figure 9:
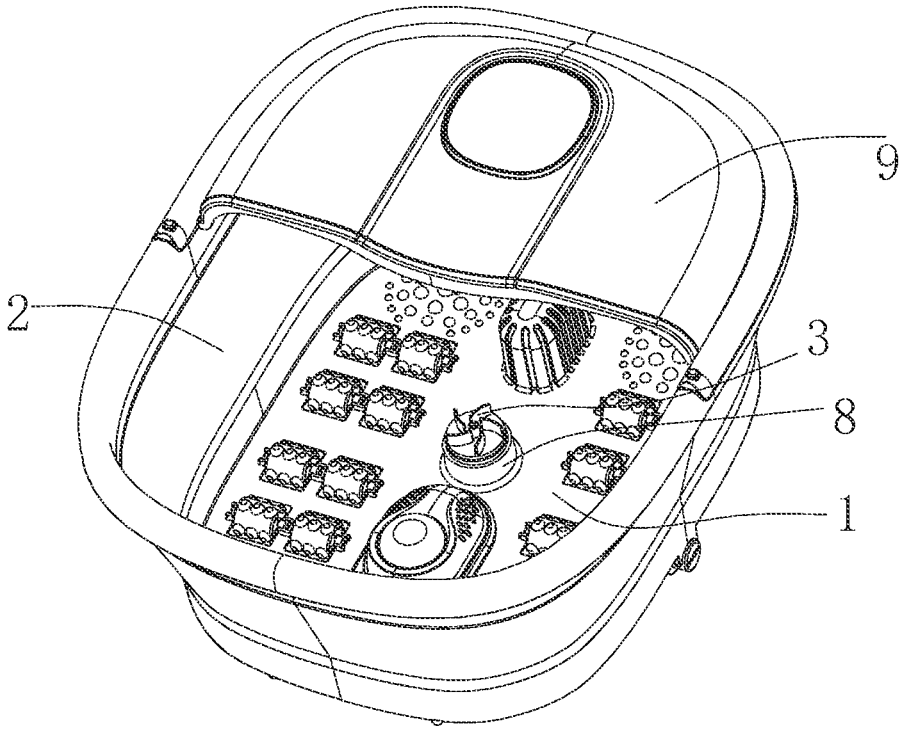
FIG. 9 is a schematic view illustrating an arrangement of an impeller in a tub chamber of the foot tub in FIG. 1.

The present disclosure is further described below with reference to the drawings and specific implementations.

Referring to FIGS. 1-16, a foot tub capable of generating a bubble in use includes base 1 and tub wall 2 connected to the base 1. The base 1 and the tub wall 2 enclose a tub chamber.

Impeller 3 is provided in the tub chamber above the base 1. The impeller 3 is covered by protective guard 4. Hollowed-out opening 5 is formed in the protective guard 4. The protective guard 4 further communicates with an outside atmosphere through vent tube 6.

Drive motor 7 is provided in the base 1. The drive motor 7 is drivingly connected to the impeller 3, such that the drive motor 7 can drive the impeller 3 to rotate.

In response to rotation of the impeller 3, while water is thrown out of the protective guard 4 through the hollowed-out opening 5 to generate a splash, a local low pressure is formed in the protective guard 4, such that outside air can enter the protective guard 4 through the vent tube 6, and the water thrown out by the impeller 3 in the rotation is mixed with the air to generate a bubble. The impeller 3 is directly located in the tub chamber, rather than in the base. As long as the impeller 3 rotates, the water can be thrown out easily to generate the splash, and a certain negative pressure can be generated in the protective guard 4 to suck the air through the vent tube 6. The drive motor 7 does not need a higher power to generate the splash and the bubble. The present disclosure generates the splash and the bubble more conveniently.

Figure 10:
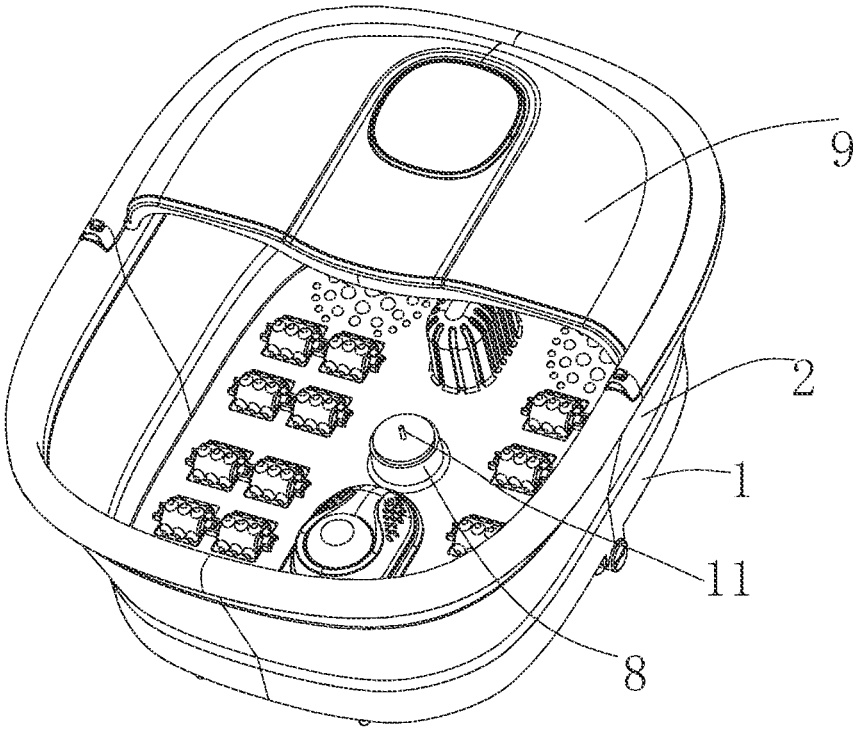
FIG. 10 is a schematic view illustrating that a connecting shaft at an output end of a drive motor of the foot tub in FIG. 1 extends into a tub chamber.
Figure 11:
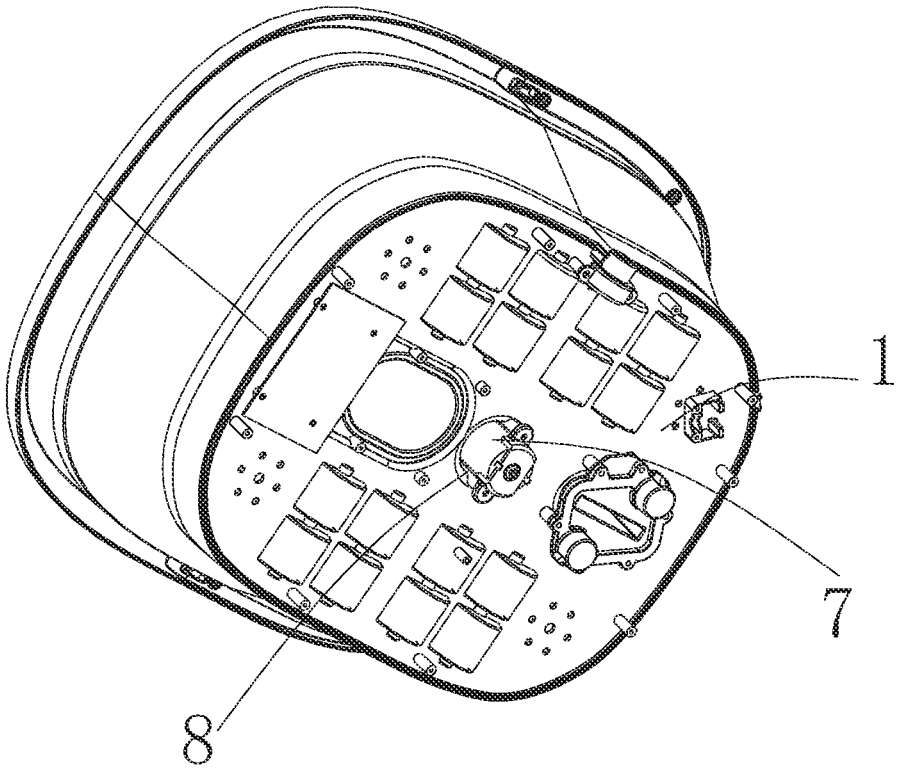
FIG. 11 is a schematic bottom view illustrating an arrangement of a drive motor of the foot tub in FIG. 1.

For ease of installation of the drive motor, as shown in FIG. 10 and FIG. 11, motor chamber 8 protruding toward the tub chamber may be formed in the base 1. The drive motor 7 is located in the motor chamber 8. On the other hand, since the impeller 3 is to be driven by the drive motor 7, the impeller 3 is located above an output end of the motor 7. In this way, the impeller 3 is located above the protruding motor chamber 8, and at a relatively high position in the tub chamber. Consequently, the splash generated by the impeller 3 in the rotation cannot be counteracted by the base, and the larger splash can be generated.

Generally, an upper end of the tub wall 2 is provided with cover plate 9. The vent tube 6 is provided between the cover plate 9 and the protective guard 4. Certainly, the vent tube may also be provided in other forms. For example, the protective guard is directly connected to a flexible tube, etc.

There may be a plurality of driving connection manners between the drive motor 7 and the impeller 3. For example, as shown in FIGS. 1-13 and FIG. 16, the output end of the drive motor 7 is provided with connecting shaft 11. The connecting shaft 11 upwardly penetrates through the base and then is connected to the impeller 3, thereby driving the impeller 3 to rotate. At a penetration position, a space between the connecting shaft 11 and the base 1 is sealed. The driving connection manner shown in FIG. 14 and FIG. 15 may further be used. That is, the output end of the drive motor 7 is provided with drive plate 12. Driving magnet 13 is provided on the drive plate 12. Driven magnet 14 is provided on the impeller 3. The driving magnet 13 is opposite to the driven magnet 14 through unlike poles, such that the drive plate 12 in rotation can drive the impeller 3 through a magnetic attraction force to rotate. In this case, a rotating shaft is preferably provided on the impeller 3. The rotating shaft is inserted into the base. The impeller 3 can rotate with the rotating shaft as an axis.

Figure 12:
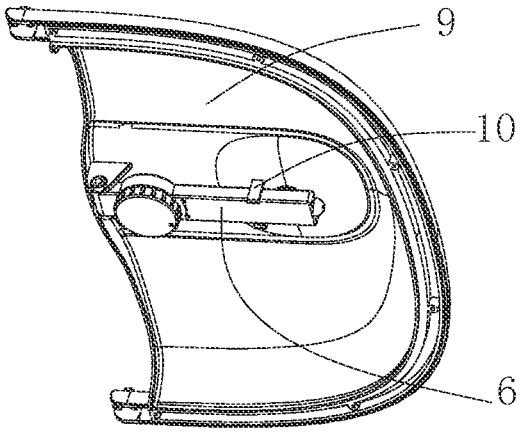
FIG. 12 is a schematic view when a tub wall of the foot tub in FIG. 1 is folded and after the vent tube is rotated.

In FIGS. 13-16, the tub wall 2 is a rigid tub wall, and is non-collapsible. The vent tube 6 is preferably provided between the cover plate 9 and the protective guard 4. In FIGS. 1-12, the tub wall 2 is a flexible tub wall, such that the tub wall 2 can be expanded or folded. When the foot tub is to be used, the flexible tub wall is expanded. The flexible tub wall is folded in storage. In this case, the vent tube cannot be a flexible tube, because the vent tube serves as a support rod when the tub wall 2 is expanded. The vent tube 6 is rotatably connected to the cover plate 9. When the tub wall 2 is expanded, the vent tube 6 is supported between the cover plate 9 and the protective guard 4, such that the vent tube 6 serves as the support rod when the tub wall 2 is expanded, to prevent collapse of the flexible tub wall 2. When the tub wall 2 is folded, the vent tube 6 is rotated and then accommodated between the cover plate 9 and the base 1, as shown in FIG. 12. Fastener 10 may be provided on the cover plate 9. The vent tube 6 is clamped on the fastener 10. Certainly, the vent tube 6 may also be rotatably connected to the protective guard 4.

There are also a plurality of air intake manners of the vent tube. For example, FIGS. 1-12 show one air intake manner, and this is based on the flexible and collapsible tub wall 2. Air inlet 15 is formed in a sidewall of the vent tube. A lower end of the vent tube 6 is provided with air outlet 16. The vent tube 6 communicates with the protective guard 4 through the air outlet 16 when supported between the cover plate 9 and the protective guard 4. Outside air enters the vent tube 6 from the air inlet 15, and then enters the protective guard 4 from the air outlet 16. In an embodiment, in order that the outside air can better enter the protective guard 4, the lower end of the vent tube 6 is provided with spherical body 17. An upper end of the protective guard 4 is provided with spherical recess 18. Air vent 19 is formed in the spherical recess 18. When the vent tube 6 is supported between the cover plate 9 and the protective guard 4, the spherical body 17 at the lower end of the vent tube 6 is embedded into the spherical recess 18, such that the air outlet 16 at the lower end of the vent tube is connected to the air vent 19. Outside air charged to the vent tube 6 enters the protective guard through the air outlet 16 and the connected air vent 19.

In an embodiment, a control mechanism capable of controlling the air inlet 15 to open or close is provided on the air inlet 15. The control mechanism may also be the control switch described in the patents CN 217645078 U and CN 217565847 U. The control mechanism not only can control air intake, but also can control an air intake amount. Certainly, the control mechanism may also be a switch in other structural forms. A simplest plug is preferably used. Inserting the plug stops the air intake, while pulling the plug open realizes the air intake. In an embodiment, as shown FIG. 1-8, the control mechanism includes control knob 20. The control knob 20 is rotatably connected to the vent tube 6 (for example, the control knob is inserted into the vent tube through a central rotating shaft). Protruding tab 21 is provided on a back of the control knob 20. Groove 22 is formed in the tab 21. By rotating the control knob 20, the tab 21 can seal the air inlet 15 to close the air inlet 15. Or by rotating the control knob 20, the groove 22 is aligned to the air inlet 15 to open the air inlet 15. As a preferred mechanism, the groove 22 is arc-shaped. The arc-shaped groove 22 is gradually widen from a head to a tail. When a narrow portion of the groove 22 corresponds to the air inlet 15 by rotating the control knob 20, the air inlet has a small air intake amount. When a wide portion of the groove 22 corresponds to the air inlet 15 by rotating the control knob 20, the air inlet has a large air intake amount. Limit rod 23 may further be provided on the back of the control knob 20. Arc-shaped limit groove 24 is formed in the vent tube 6. The limit rod 23 is located in the limit groove 24. When the limit rod 23 is located at two ends of the limit groove 24 by rotating the control knob 20, the air inlet 15 is closed or opened, for ease of control. Certainly, the groove 22 may also not be formed. By rotating the control knob 20, the tab 21 can seal the air inlet 15 to close the air inlet 15. By rotating the control knob 20, the tab 21 can be separated from the air inlet 15 to open the air inlet 15.

In an embodiment, also as shown in FIG. 2-8, the vent tube 6 includes first rod 6-1 and second rod 6-2. The first rod 6-1 and the second rod 6-2 are assembled to form the vent tube 6. This structure is advantageous. There is a need to form a venting passage in the vent tube 6. Integral formation of the vent tube is troublesome. By separating the vent tube into the first rod 6-1 and the second rod 6-2, the formation of the vent tube is relatively simple.

Figure 13:
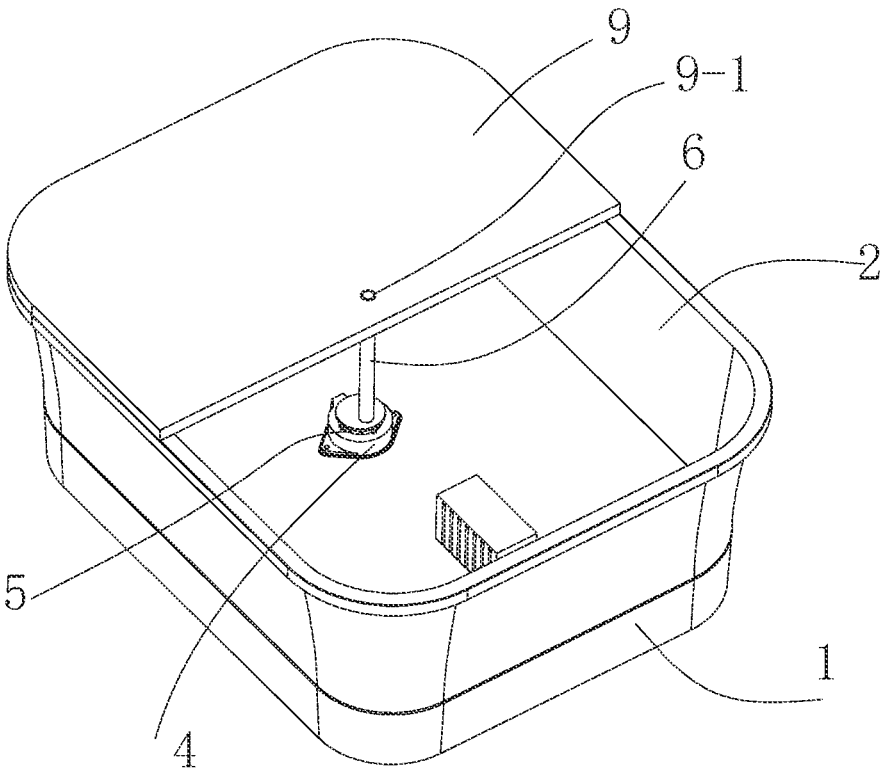
FIG. 13 is a schematic structural view of a foot tub with a non-collapsible tub wall.
Figure 14:
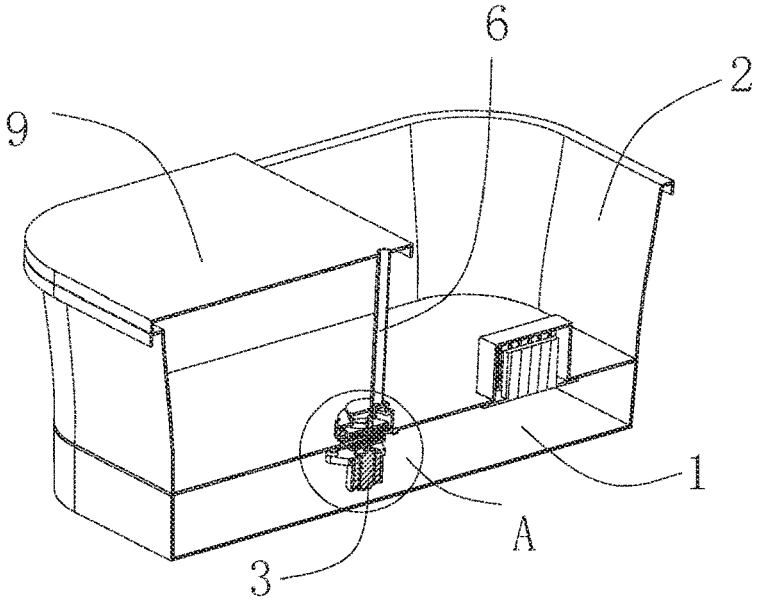
FIG. 14 is a sectional view of the foot tub in FIG. 13.
Figure 15:
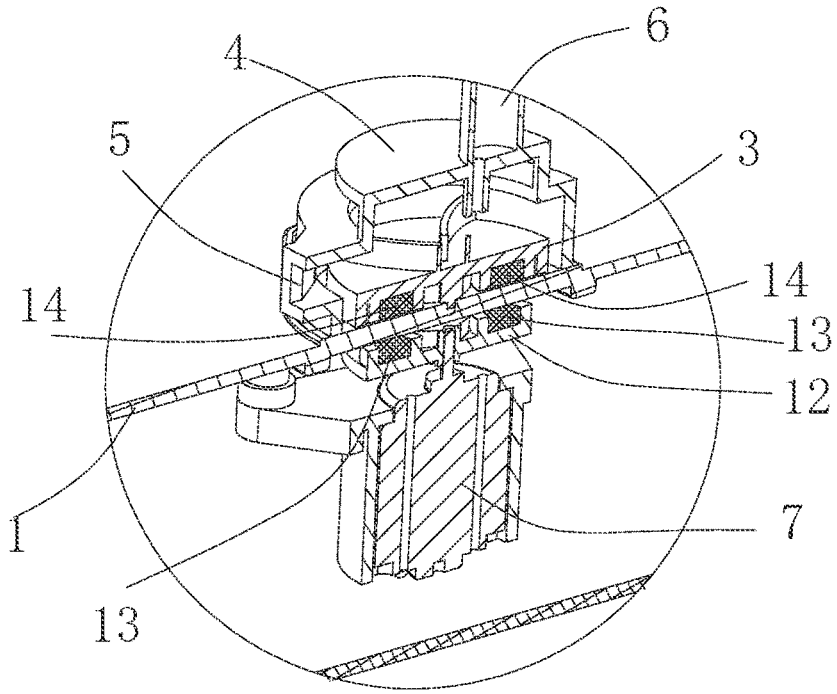
FIG. 15 is a partially enlarged view of A in FIG. 14.
Figure 16:
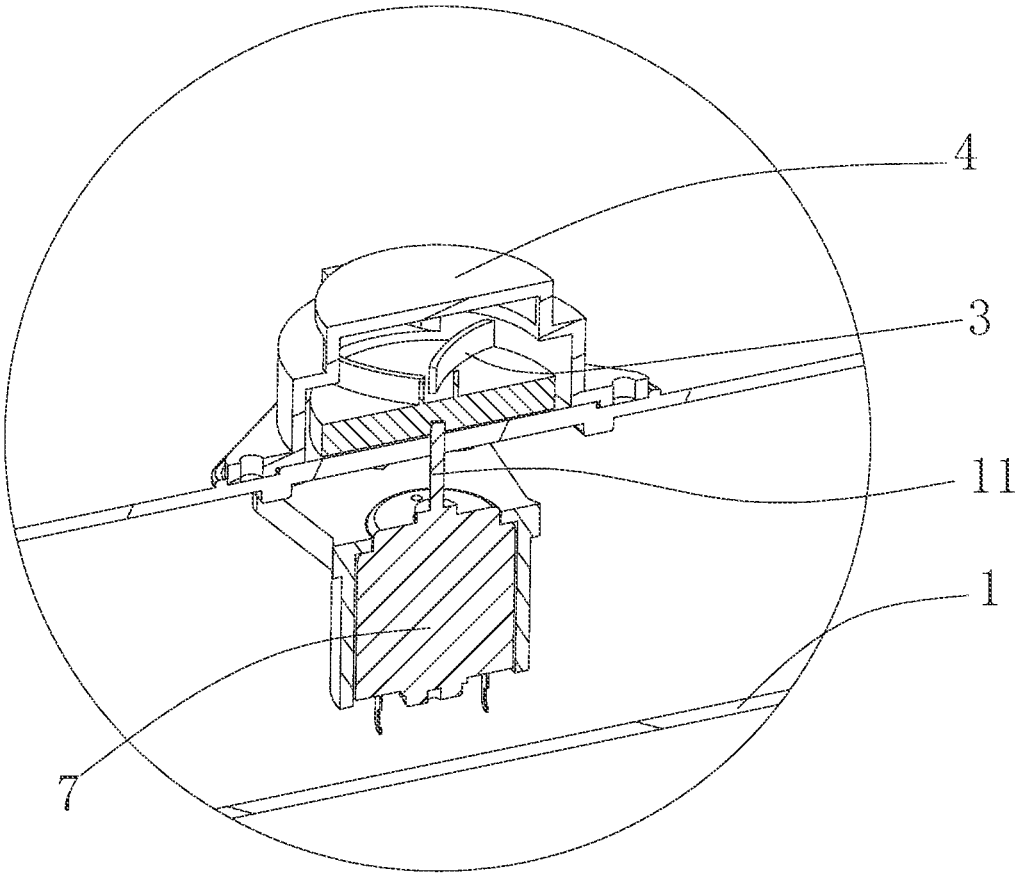
FIG. 16 is a schematic structural view of another driving manner of an impeller of the foot tub in FIG. 13.

For example, FIG. 13 and FIG. 14 show another air intake manner of the vent tube 6. Cover plate air inlet 9-1 is formed in the cover plate 9. An upper opening of the vent tube 6 is connected to the cover plate air inlet 9-1. Outside air enters the vent tube 6 from the cover plate air inlet 9-1. The upper end of the vent tube 6 is preferably inserted into the cover plate air inlet 9-1 to achieve a more stable structure. A control switch for controlling the air intake may further be provided on the cover plate air inlet 9-1. The control switch may be the control switch described in the patents CN 217645078 U and CN 217565847 U. The control switch not only can control the air intake, but also can control the air intake amount. Certainly, the control switch may also be a switch in other structural forms. The simplest plug is preferably used. Inserting the plug stops the air intake, while pulling the plug open realizes the air intake.

In the description of this specification, the description with reference to the terms "an embodiment", "some embodiments", "an example", "a specific example", or "some examples" means that specific features, structures, materials or characteristics described with reference to the embodiment or example are included in at least one embodiment or example of the present disclosure. In this specification, the schematic representations of the above terms do not necessarily refer to the same embodiment or example. In addition, the specific features, structures, materials, or characteristics described may be combined in any suitable manner in any one or more embodiments or examples.

The foregoing illustrates the implementations of the present disclosure. However, the present disclosure is not limited to the aforementioned implementations. Any modifications, equivalent substitutions, improvements, etc. made within the spirit and principle of the present disclosure should be included in the protection scope of the present disclosure.

What is claimed is:

1. A foot tub capable of generating a bubble in use, comprising a base and a tub wall connected to the base, wherein the base and the tub wall enclose a tub chamber;

an impeller is provided in the tub chamber above the base;

the impeller is covered by a protective guard; a hollowed-out opening is formed in the protective guard; and the protective guard further communicates with an outside atmosphere through a vent tube;

a drive motor is provided in the base, and the drive motor is drivingly connected to the impeller, such that the drive motor drives the impeller to rotate;

in response to rotation of the impeller, while water is thrown out of the protective guard through the hollowed-out opening, a local low pressure is formed in the protective guard, such that outside air enters the protective guard through the vent tube, and the water thrown out by the impeller in the rotation is mixed with the air to generate a bubble;

wherein an upper end of the tub wall is provided with a cover plate, and the vent tube is provided between the cover plate and the protective guard;

a driving connection manner between the drive motor and the impeller is as follows: an output end of the drive motor is provided with a drive plate;

a driving magnet is provided on the drive plate; a driven magnet is provided on the impeller; and the driving magnet is opposite to the driven magnet through unlike poles, such that the drive plate in rotation drives the impeller through a magnetic attraction force to rotate; and a rotating shaft is provided on the impeller; the rotating shaft is inserted into the base; and the impeller rotates with the rotating shaft as an axis.

2. The foot tub capable of generating the bubble in use according to claim 1, wherein the base is provided with a motor chamber protruding toward the tub chamber, and the drive motor is located in the motor chamber.

3. The foot tub capable of generating the bubble in use according to claim 1, wherein a cover plate air inlet is formed in the cover plate, and an upper opening of the vent tube is connected to the cover plate air inlet.

4. The foot tub capable of generating the bubble in use according to claim 1, wherein the tub wall is a flexible tub wall, such that the tub wall is allowed to be expanded or folded;

the vent tube is rotatably connected to the cover plate, or the vent tube is rotatably connected to the protective guard; when the tub wall is expanded, the vent tube is supported between the cover plate and the protective guard, such that the vent tube serves as a support rod when the tub wall is expanded; and when the tub wall is folded, the vent tube is rotated and then accommodated between the cover plate and the base.

5. A foot tub capable of generating the bubble in use, comprising a base and a tub wall connected to the base, wherein the base and the tub wall enclose a tub chamber;

an impeller is provided in the tub chamber above the base; the impeller is covered by a protective guard; a hollowed-out opening is formed in the protective guard; and the protective guard further communicates with an outside atmosphere through a vent tube;

a drive motor is provided in the base, and the drive motor is drivingly connected to the impeller, such that the drive motor drives the impeller to rotate; and in response to rotation of the impeller, while water is thrown out of the protective guard through the hollowed-out opening, a local low pressure is formed in the protective guard, such that outside air enters the protective guard through the vent tube, and the water thrown out by the impeller in the rotation is mixed with the air to generate a bubble;

wherein an upper end of the tub wall is provided with a cover plate, and the vent tube is provided between the cover plate and the protective guard;

wherein a cover plate air inlet is formed in the cover plate, and an upper opening of the vent tube is connected to the cover plate air inlet.

6. The foot tub capable of generating the bubble in use according to claim 5, wherein a control switch for controlling air intake is provided on the cover plate air inlet.

7. A foot tub capable of generating the bubble in use, comprising a base and a tub wall connected to the base, wherein the base and the tub wall enclose a tub chamber;

an impeller is provided in the tub chamber above the base; the impeller is covered by a protective guard; a hollowed-out opening is formed in the protective guard; and the protective guard further communicates with an outside atmosphere through a vent tube;

a drive motor is provided in the base, and the drive motor is drivingly connected to the impeller, such that the drive motor drives the impeller to rotate; and in response to rotation of the impeller, while water is thrown out of the protective guard through the hollowed-out opening, a local low pressure is formed in the protective guard, such that outside air enters the protective guard through the vent tube, and the water thrown out by the impeller in the rotation is mixed with the air to generate a bubble;

wherein an upper end of the tub wall is provided with a cover plate, and the vent tube is provided between the cover plate and the protective guard;

wherein the tub wall is a flexible tub wall, such that the tub wall is allowed to be expanded or folded;

the vent tube is rotatably connected to the cover plate, or the vent tube is rotatably connected to the protective guard; when the tub wall is expanded, the vent tube is supported between the cover plate and the protective guard, such that the vent tube serves as a support rod when the tub wall is expanded; and when the tub wall is folded, the vent tube is rotated and then accommodated between the cover plate and the base.

8. The foot tub capable of generating the bubble in use according to claim 7, wherein the vent tube comprises a first rod and a second rod; and the first rod and the second rod are assembled to form the vent tube.

9. The foot tub capable of generating the bubble in use according to claim 7, wherein an air inlet is formed in a sidewall of the vent tube; a lower end of the vent tube is provided with an air outlet; and the vent tube communicates with the protective guard through the air outlet when supported between the cover plate and the protective guard.

10. The foot tub capable of generating the bubble in use according to claim 9, wherein the lower end of the vent tube is provided with a spherical body; an upper end of the protective guard is provided with a spherical recess; an air vent is formed in the spherical recess; and when the vent tube is supported between the cover plate and the protective guard, the spherical body at the lower end of the vent tube is embedded into the spherical recess, such that the air outlet at the lower end of the vent tube is connected to the air vent.

11. The foot tub capable of generating the bubble in use according to claim 9, wherein a control mechanism for controlling the air inlet to open or close is provided on the air inlet.

12. The foot tub capable of generating the bubble in use according to claim 11, wherein the control mechanism comprises a control knob; and the control knob is rotatably connected to the vent tube; and a protruding tab is provided on a back of the control knob; a groove is formed in the protruding tab; and by rotating the control knob, the protruding tab seals the air inlet to close the air inlet, or the groove is aligned to the air inlet to open the air inlet.

13. The foot tub capable of generating the bubble in use according to claim 12, wherein the groove is arc-shaped; the arc-shaped groove is gradually widen from a head to a tail; when a narrow portion of the groove corresponds to the air inlet, the air inlet has a small air intake amount; and when a wide portion of the groove corresponds to the air inlet, the air inlet has a large air intake amount.

* * * * *